US008740592B2

(12) United States Patent
Zwickler et al.

(10) Patent No.: US 8,740,592 B2
(45) Date of Patent: Jun. 3, 2014

(54) ADJUSTABLE VANE CELL PUMP WITH A SLIDE COMPRISING RECESSES

(75) Inventors: Georg Zwickler, Taunusstein (DE); Herbert Schmitz, Wiesbaden (DE)

(73) Assignee: GM Global Technology Operations LLC, Detroit, MI (US)

( * ) Notice: Subject to any disclaimer, the term of this patent is extended or adjusted under 35 U.S.C. 154(b) by 124 days.

(21) Appl. No.: 13/371,597

(22) Filed: Feb. 13, 2012

(65) Prior Publication Data

US 2012/0213654 A1 Aug. 23, 2012

(30) Foreign Application Priority Data

Feb. 18, 2011 (DE) ..... 10 2011 011 690

(51) Int. Cl.
*F03C 2/00* (2006.01)
*F04C 2/00* (2006.01)
*F04C 14/18* (2006.01)

(52) U.S. Cl.
USPC ..... 418/24; 418/16; 418/26; 418/27; 418/30; 418/259; 417/220

(58) Field of Classification Search
USPC ..... 418/16, 24–30, 259, 266–268; 417/218–220
See application file for complete search history.

(56) References Cited

U.S. PATENT DOCUMENTS

| | | | | |
|---|---|---|---|---|
| 2,658,456 | A | 11/1953 | Wahlmark | |
| 5,538,400 | A * | 7/1996 | Konishi et al. | 418/26 |
| 2009/0269232 | A1 * | 10/2009 | Williamson et al. | 418/24 |

FOREIGN PATENT DOCUMENTS

| | | | |
|---|---|---|---|
| DE | 3446603 | A1 | 7/1985 |
| DE | 10346095 | A1 | 4/2005 |
| DE | 102006047849 | A1 | 4/2008 |
| KR | 1020050058689 | A | 6/2005 |

OTHER PUBLICATIONS

German Patent Office, German Search Report for Application No. 102011011690.7, dated Oct. 13, 2011.

* cited by examiner

*Primary Examiner* — Theresa Trieu
(74) *Attorney, Agent, or Firm* — Ingrassia Fisher & Lorenz, P.C.

(57) ABSTRACT

An adjustable vane cell pump is provided having a rotor, which includes, but is not limited to bearing slots extending in radial direction, in which cane plates displaceable relative to the bearing slots are arranged. The vane cell pump further includes, but is not limited to an adjustable slide having a substantially cylindrical inner surface. The rotor is configured in order to driveably rotate about a rotary axis within the slide. The vane plates bear against the inner surface of the slide, and the slide further includes, but is not limited to a first and a second areal end face, as well as recesses, which outer-circumferentially extend parallel to the end faces.

7 Claims, 3 Drawing Sheets

ADJUSTABLE VANE CELL PUMP WITH A SLIDE COMPRISING RECESSES

CROSS-REFERENCE TO RELATED APPLICATION

This application claims priority to German Patent Application No. 10 2011 011 690.7, filed Feb. 18, 2011, which is incorporated herein by reference in its entirety.

TECHNICAL FIELD

The technical field relates to an adjustable vane cell pump having a rotor, which comprises bearing slots extending in radial direction, in which vane plates displaceable relative to the bearing slots are arranged, and an adjustable slide having a substantially cylindrical inner surface. The rotor is designed to driveably rotate within the slide about a rotary axis, and the vane plates bear against the inner surface of the slide.

BACKGROUND

An adjustable vane cell pump is known from DE 103 46 095. Vane cell pumps are employed as delivery pump for cooling or lubricating oil in a combustion engine. In order to vary the rate of delivery the slide of adjustable vane cell pumps are adjustable. Because of this, the eccentricity of the rotor within the slide is changed, as a result of which a volume delivered per revolution can be varied.

At least one object is reducing the weight of a vane cell pump. In addition, other objects, desirable features, and characteristics will become apparent from the subsequent summary and detailed description, and the appended claims, taken in conjunction with the accompanying drawings and this background.

SUMMARY

Accordingly, an adjustable vane cell pump is provided that has a rotor, which comprises bearing slots extending in radial direction in which vane plates are arranged displaceable relative to the bearing slots. The vane cell pump furthermore comprises an adjustable slide having a substantially cylindrical inner surface. The rotor is designed to driveably rotate about a rotary axis within the slide. The vane plates bear against the inner surface of the slide. the slide furthermore comprises a first and a second areal end face, and recesses, which extend outer-circumferentially parallel to the end faces.

The end faces form an axial boundary of the slide. In the assembled state of the vane cell pump, the end faces bear against covers. The recesses are arranged slot-like on a side of the slide facing to the outside. With a narrow edge located outside, the vane plates bear against the inner surface of the slide.

According to an embodiment, the recesses are interrupted at an adjusting lever on which in the assembled state an adjusting means for adjusting the slide is acting. A volume of oil delivered per revolution of the rotor can be varied in that the slide is adjusted. The position of the rotor relative to the slide or to the inner surface of the slide is varied because of this. The greater the eccentricity of the rotor, the greater the free spaces remaining between the vane plates become in which oil is delivered. In that the recesses in the region of the adjusting lever are interrupted, the adjusting lever can be designed unitarily, so that a high stability is guaranteed.

According to an embodiment, the recesses are furthermore interrupted at an articulation point, with which the slide can be pivotably arranged in a pump housing. Because of this, the slide is stabilized in the region of the articulation point.

According to an embodiment, the recesses are interrupted on a sealing land protruding radially to the outside and suitable for receiving a sealing strip. Because of this, the sealing effect of the sealing strip cannot be impaired by the recesses.

According to an embodiment, a fluid-conducting pump housing portion in the assembled state of the vane cell pump protrudes into at least one recess in at least one position. Through the recess, installation space in which for example an oil line or a fastening device can be arranged, is gained. The fastening device can be a screw past through the pump housing portion, which corresponding to the recesses, runs tangentially past the slide.

According to an embodiment, the vane plates are held radially inside via at least one guide ring arranged concentrically to the slide and pressed against the inner surface of the slide. Because of this a vane cell pump can be created, in which the vane plates slide off the inner wall of the slide with low friction yet in a sealing manner. The guide ring can be positively guided relative to the slide, but it can also be held in position by the vane plates.

A use of the described adjustable vane cell pump for delivering oil in a combustion engine. In combustion engines of motor vehicles, the rotational speed can vary between approximately 300 revolutions per minute and approximately 8,000 revolutions per minute. The demand for delivered cooling and lubricating oil however does not rise linearly with the rotational speed. It has been shown that with increasing rotational speed the volumetric flow of oil with adequate cooling and lubricating effect can be reduced, because of which losses can be avoided, and thus fuel saved. The adjustment can take place by way of the vane cell pump described here.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
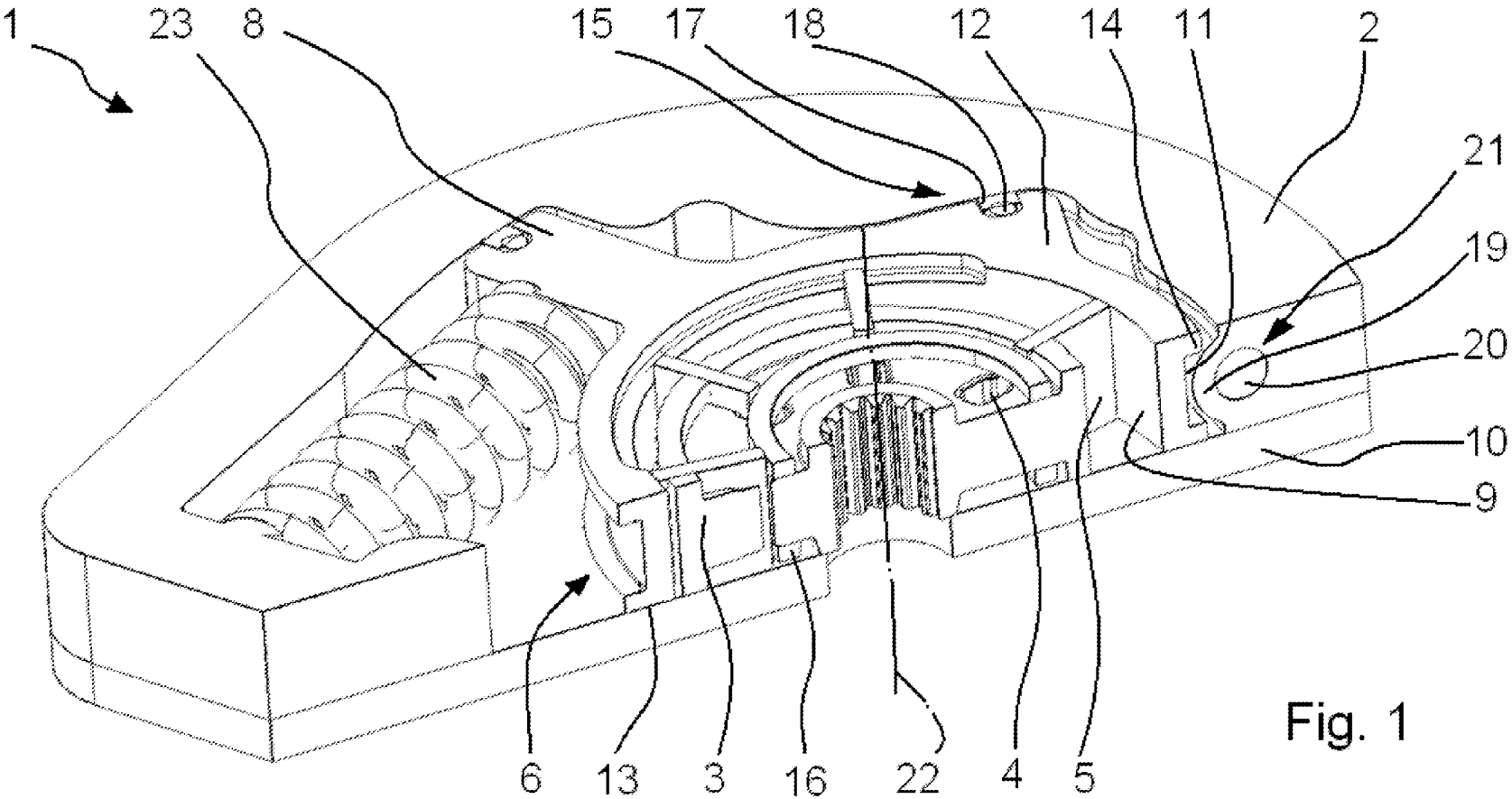
FIG. 1 is a schematic representation a detail of a vane cell pump having a rotor which is rotatably arranged in a slide.

In FIG. 1 a detail of a vane cell pump 1 having a rotor 3 mounted in a pump housing 2 is schematically shown. On the rotor 3, a plurality of vane plates 5 that are mounted in bearing slots 4 in a radially displaceable manner, are arranged. The rotor 3 rotates within a slide 6. The vane plates 5 are pressed against the slide 6 in a sealing manner via guide rings 16 arranged above and below the rotor 3. Here, the guide ring is arranged concentrically to the slide. The slide 6 in this exemplary embodiment is rotatably mounted about an articulation point 7 (see FIG. 2). The slide 6 can be adjusted via an adjusting means 23 acting on an adjusting lever 8. Under the rotor 3 and the slide 6 a cover 10 is arranged, which areally bears against the rotor 3 or the slide 6. In the assembled state, the pump housing 2 is closed via a cover located at the top, which is not shown. In the cover which is not shown and the covers 10 recesses for the axial supply and discharge of oil can be arranged. By adjusting the slide 6 an oil volume delivered per revolution can be varied.

Figure 2:
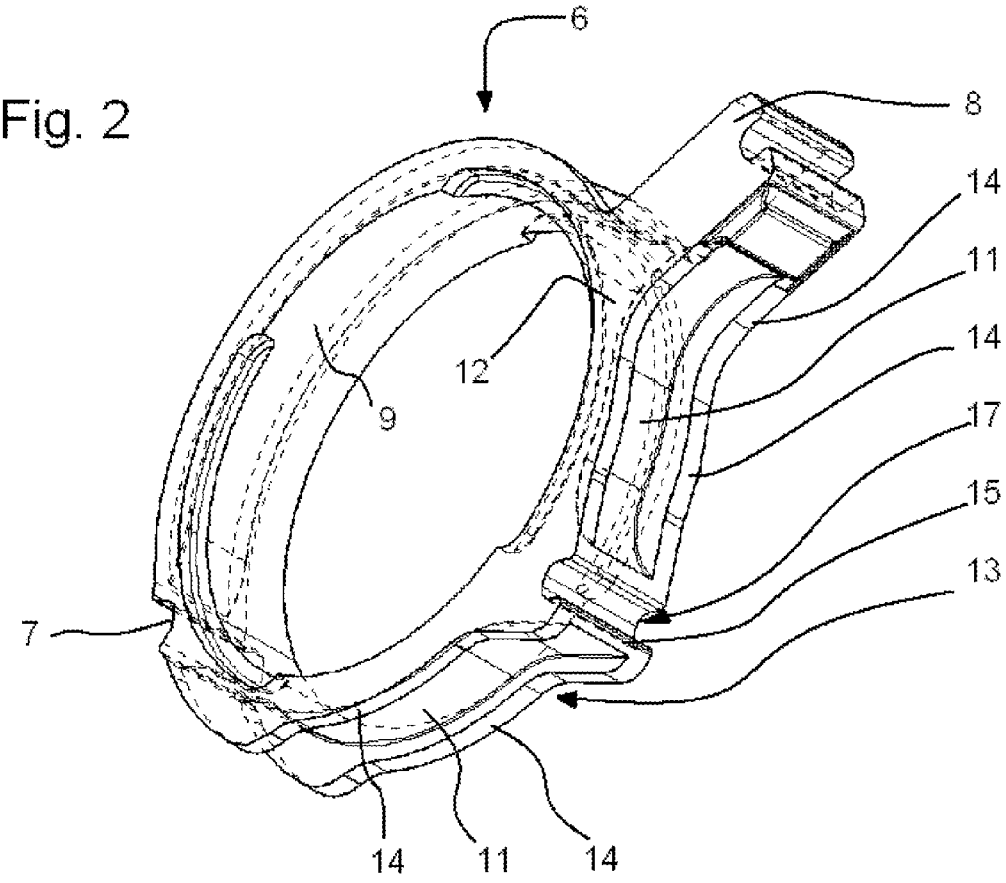
FIG. 2 is a perspective representation a slide with recesses outer-circumferentially arranged therein.

FIG. 2 shows a slide 6 with a substantially cylindrical inner surface 9. On the side in the picture facing into the upper right-hand corner, the adjusting lever 8 is arranged. On the side facing into the lower left-hand corner an articulation point 7 designed as roundish recess is arranged. On the articulation point 7, a pin, which is not shown in the drawing and arranged on the pump housing 2, can engage, because of which a pivotability of the slide 6 is achieved. The pivoting can be controlled by way of adjusting means 23 acting on the adjusting lever 8. On a side facing to the right a sealing land 15 with a sealing slot 17 is arranged. In the assembled state, a sealing strip 18 shown in FIG. 1 can be arranged in the sealing slot 17. The adjusting means 23 can also be a simple spring against which an adjustable hydraulic control pressure is acting.

On the slide 6, outer-circumferential recesses 11 are arranged. These can be introduced into the slide 6 through a milling operation after a manufacturing process, for example a sintering process. Here, preferentially as shown in FIG. 2, thick portions 14 are left standing on a first end face 12 and on a second end face 13 of the slide 6. The thick portions 14 ensure a high dimensional stability of the slide 6 and increase the sealing width and thus the volumetric efficiency of the pump. By providing recesses 11 on the slide 6 the weight of the slide 6 is reduced. Since slides 6 for vane cell pumps are usually sintered or cast, producing undercuts (i.e. slot-like recesses) in axially direction is rendered more difficult. For this reason, the recesses 11 have to be milled in a milling operation connected downstream.

Figure 3:
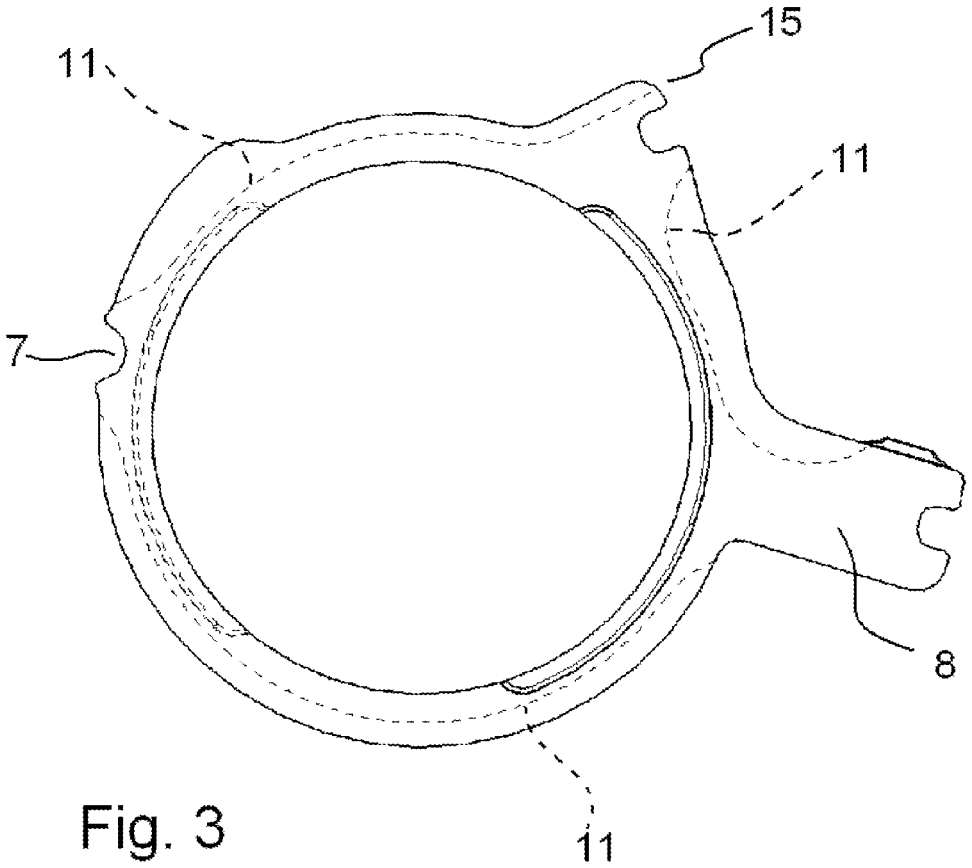
FIG. 3 is a schematic representation a slide from a lateral view with recesses shown in interrupted line.

A possible tool guiding path for a milling tool, which is not shown with respect to a slide 6, is indicated by interrupted lines in FIG. 3. Along this tool guiding path a milling tool creating the recesses 11, can be guided. Here, the milling tool can have the desired width of the recess 11 in axial direction so that only one operation is necessary for each recess 11. The recesses 11 are likewise shown in interrupted line.

Furthermore, FIG. 3 illustrates that on the articulation point 7, on the adjusting lever 8 and on a sealing land 15 the recesses 11 are interrupted in circumferential directions. It has been shown that the weight of the slide 6 can be reduced by approximately 20% to approximately 30% through the milling-out of recesses 11 without impairing the stability and the sealing characteristics of the slide 6.

Referring back to FIG. 1 once again a further aspect of the invention is pointed out. Through the recesses 11 a space-saving arrangement of surrounding functional elements such as for example a pump housing portion 21 can be achieved. The pump housing portion 21 can be formed by an outer wall 19 of a bore 20 running through the pump housing 2. The bore 20 can serve for receiving a fastening device for the pump housing 2, but also for passing through oil. Because of this, the pump housing 2 can be constructed in a compact manner.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An adjustable vane cell pump, comprising:

a rotor comprising bearing slots extending in radial direction;

vane plates that are displaceable relative to the bearing slots; and an adjustable slide comprising a substantially cylindrical inner surface and an outer surface, wherein the rotor is configured to driveably rotate about a rotary axis within the adjustable slide, wherein the vane plates are configured to bear against an inner surface of the adjustable slide, wherein the adjustable slide further comprises a first areal end face opposite a second areal end face and a plurality of recesses that outer-circumferentially extend along the outer surface of the adjustable slide parallel to the first areal end face and the second areal end face, with a first one of the plurality of recesses extending along the outer surface from an articulation point associated with the adjustable slide to an adjusting lever of the adjustable slide and a second one of the plurality of recesses extending along the outer surface from the adjusting lever to a sealing land defined in the adjustable slide.

2. The adjustable vane cell pump according to claim 1, wherein an adjusting device configured to adjust the adjustable slide acts on the adjusting lever.

3. The adjustable vane cell pump according to claim 1, wherein the adjustable slide is configured to pivot about the articulation point in a pump housing.

4. The adjustable vane cell pump according to claim 1, wherein the sealing land radially protrudes to the outside of the adjustable slide and is suitable for receiving a sealing strip.

5. The adjustable vane cell pump according to claim 1, wherein a fluid-conducting pump housing portion in an assembled state of the adjustable slide protrudes into at least one recess of the plurality of recesses at least in one position of the adjustable vane cell pump.

6. The adjustable vane cell pump according to claim 1, wherein a pump housing portion includes a bore for receiving a fastening device in an assembled state of the adjustable vane cell pump and the bore protrudes into at least one recess of the plurality of recesses at least in one position of the adjustable slide.

7. The adjustable vane cell pump according to claim 1, wherein the vane plates are held radially inside with at least one guide ring arranged concentrically to the adjustable slide and are pressed against the inner surface of the adjustable slide.

* * * * *